US005893021A

United States Patent [19]

Yanashima

[11] Patent Number: 5,893,021

[45] Date of Patent: Apr. 6, 1999

[54] SHEET FEEDING SYSTEM INCLUDING LEADING EDGE DETECTION

[75] Inventor: Tsukasa Yanashima, Tokyo, Japan

[73] Assignee: Asahi Kogaku Kogyo Kabushiki Kaisha, Tokyo, Japan

[21] Appl. No.: 917,335

[22] Filed: Aug. 25, 1997

[30] Foreign Application Priority Data

Aug. 29, 1996 [JP] Japan ..... 8-247128

[51] Int. Cl.[6] ..... G03G 15/00

[52] U.S. Cl. ..... 399/384; 226/23; 226/27

[58] Field of Search ..... 399/384, 385, 399/387; 226/23, 27, 43, 45

[56] References Cited

U.S. PATENT DOCUMENTS

| | | | |
|---|---|---|---|
| 4,897,675 | 1/1990 | Negishi | 347/133 |
| 4,912,490 | 3/1990 | Negoro et al. | 347/139 |
| 4,949,104 | 8/1990 | Negoro et al. | 347/139 |
| 5,194,903 | 3/1993 | Negishi et al. | 399/384 |
| 5,210,583 | 5/1993 | Monma | 399/384 |
| 5,212,531 | 5/1993 | Monma et al. | 399/16 |
| 5,493,318 | 2/1996 | Negoro et al. | 346/136 |
| 5,532,811 | 7/1996 | Nishikawa et al. | 399/384 |
| 5,564,845 | 10/1996 | Yamaguchi et al. | 400/582 |
| 5,565,972 | 10/1996 | Honda et al. | 399/384 |

*Primary Examiner*—William Royer
*Attorney, Agent, or Firm*—Greenblum & Bernstein, P.L.C.

[57] ABSTRACT

In a continuous form printer, a passage of the leading edge of the sheet is detected by a top sensor located along a feeding path thereof. If the top sensor detects the leading edge of the sheet while the sheet is fed in a reverse direction, the control unit of the printer determines whether the detection of the leading edge by the top sensor is correct or not, by feeding the sheet once in the forward direction and then feeding the sheet in the reverse direction and by checking whether the top sensor again detects the leading edge of the sheet being fed in the reverse direction.

18 Claims, 7 Drawing Sheets

SHEET FEEDING SYSTEM INCLUDING LEADING EDGE DETECTION

BACKGROUND OF THE INVENTION

The invention relates to a continuous sheet feeding system for a printer.

The present invention relates to a sheet feeding system for feeding a sheet such as a continuous form sheet used in a continuous form printer or the like.

A sheet feeding system is provided with a top sensor for detecting the passage of a leading edge of a sheet being fed by the feeding system. The top sensor generally includes a swingable lever swingable between an erect position, where the swingable lever projects across the feeding path of the sheet, and a retracted position, where the swingable lever does not project into the feeding path. When the sheet is present at the position of the swingable lever, the swingable lever is pressed down by the sheet below the feeding path. The top sensor further includes a detecting sensor for detecting the position of the swingable lever. In general, the detecting sensor is arranged to generate an OFF signal when the swingable lever is in the erect position and to generate an ON signal when the swingable lever is in the retracted position. The passage of the leading edge of the sheet can be detected in response to a change in the signal from the detecting sensor.

However, there is a possibility that the sheet may bend or be warped, causing a portion of the sheet to be deflected upward. In this case, if the portion of the sheet deflected upward is above the swingable lever of the top sensor, the swingable lever may not be pressed down by the sheet even though the sheet is present. Consequently, the detecting sensor may incorrectly send an OFF signal even though the continuous form sheet is correctly positioned. In such case, a control unit of the printer may mistakenly determine a leading edge of the sheet, which causes a deviation of the printing position on the sheet.

More particularly, a recent continuous form printer using a continuous form sheet is arranged to discharge a printed page of the continuous form sheet out of the printer so that a user may check the result of the printing or may separate a page from the continuous form sheet. In such a printer, since a user touches the discharged page for checking or separating, the chance of the continuous form sheet being bent (or warped) and deflected is increased. Thus, the above-mentioned incorrect detection of the leading edge and resulting incorrect printing may occur more often.

SUMMARY OF THE INVENTION

It is therefore an object of the present invention to provide a sheet feeding system in which an incorrect detection of the leading edge of the sheet is prevented.

For this purpose, according to one aspect of the present invention, there is provided a printer including a tractor unit capable of feeding the sheet in first and second directions, a top sensor that detects the passage of a leading edge of the sheet fed by the tractor unit, and a control unit which controls the tractor unit and determines whether the detection of the leading edge by the top sensor is correct or not. When the top sensor detects the leading edge of the sheet fed in the first direction, the control unit controls the tractor unit to once feed the sheet in the second direction and then to feed the sheet in the first direction by a predetermined amount, and determines whether the top sensor again detects the passage of the leading edge of the sheet being fed in the first direction.

If the detection of the leading edge by the top sensor is correct (if the detected leading edge is an 'actual' leading edge), the top sensor again detects the leading edge while the sheet is fed in the first direction after the sheet has been once fed in the second direction. Conversely, if the detection of the leading edge is not correct (if, for example, the detected leading edge is a bent portion of the sheet), the top sensor does not again detect the leading edge while the sheet is fed in the first direction after the sheet has been once fed in the second direction. Thus, it is possible to determine whether the detection of the leading edge is correct or not.

In one particular arrangement, the control unit controls the tractor unit to feed the sheet in the second (forward) direction when the printer prints images on the sheet. The control unit further controls the tractor unit to feed the sheet in the second (forward) direction to once discharge a printed portion of the sheet out of the printer upon completion of the printing, and to retract the sheet in the first (reversed) direction before the next printing is started.

In another particular arrangement, a tensioning system is provided to give a tension to the sheet. In particular, the top sensor is located downstream of the tractor unit in the second direction and the tensioning system is located downstream of the top sensor in the second direction. Preferably, the tensioning system includes a pair of rollers sandwiching the sheet. A circumferential speed of at least one of the pair of rollers is larger than the feeding speed of the sheet. With such an arrangement, the bending of the sheet can be removed while the sheet is once fed in the second direction.

Optionally, the top sensor includes a swingable lever swingable between an erect position, wherein the swingable lever projects across a sheet feeding path of the sheet, and a retracted position, wherein the said swingable lever is retracted from the erect position. A sensor detects the position of the swingable lever. Particularly, the top sensor is arranged to output a first signal indicating that the lever member is in the erect position and a second signal indicating that the lever member is in the retracted position.

According to another aspect of the present invention, there is provided a feeding system including a tractor unit which feeds the sheet, a top sensor which detects a leading edge of the sheet fed by the tractor unit, and a control unit which controls the tractor unit and determines whether the detection of the top sensor is correct or not. If the top sensor detects the leading edge of the sheet fed in the first direction, the control unit controls the tractor unit to feed the sheet in the second direction and then to feed the sheet in the first direction by a predetermined amount, and determines whether the top sensor again detects the passage of the leading edge of the sheet being fed in the first direction.

DETAILED DESCRIPTION OF THE DRAWINGS

Figure 1:
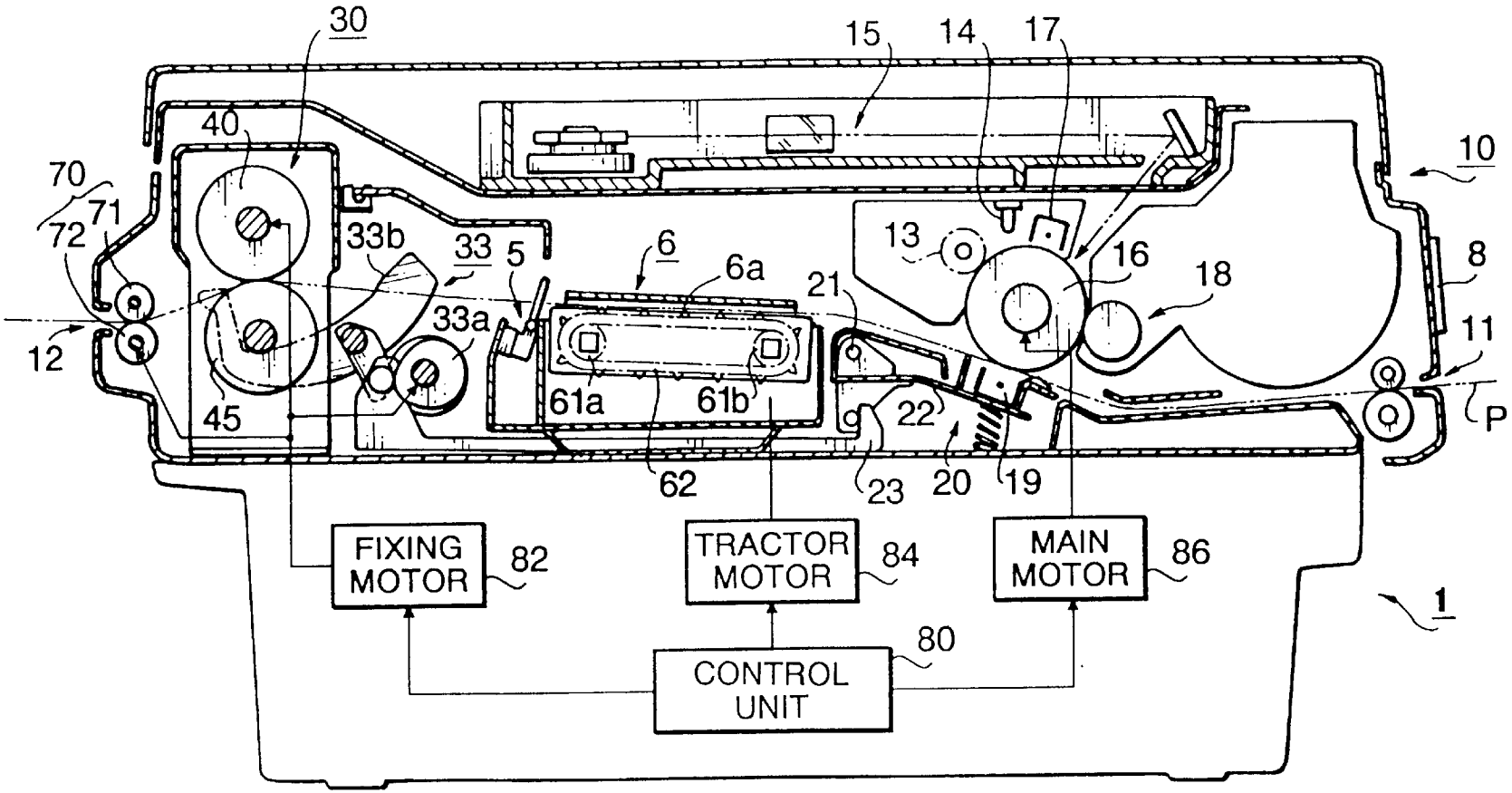
FIG. 1 is a side view of a printer according to an embodiment of the invention.

An embodiment of the present invention is described with reference to the accompanying drawings. FIG. 1 shows a continuous form printer 1 arranged to print images on a continuous-form sheet P (hereinafter a sheet P) using electrophotographic technology. The sheet P has a discrete page length defined by perforations between pages.

The printer 1 includes a laser scanning unit 15 for emitting a laser beam, a photoconductive drum 16 on which a latent image is formed by the laser beam emitted from the laser scanning unit 15. A developing unit 18 applies toner to the latent image formed on the drum 16, and a transfer unit 20 transfers the toner image from the drum 16 onto the sheet P. A fixing unit 30 fixes the toner image on the sheet P. All of these units are accommodated in a housing 10.

The printer 1 further includes a cleaning unit 13 for removing residual toner on the drum 16, a discharge unit 14 for discharging the surface of the drum 16, and a charging unit 17 for uniformly charging the surface of the drum 16.

The sheet P enters into the housing 10 from a sheet inlet 11 provided at one side of the housing 10. In the housing 10, the sheet P passes through the transfer unit 20 and fixing unit 30 along a predetermined feeding path. Then, the sheet P is discharged from the housing 10 from a sheet outlet 12 provided at the other side of the housing 10. A feeding of the sheet P in the housing 10 is performed by a tractor unit 6 (detailed below) provided between the transfer unit 20 and the fixing unit 30. Further, the printer 1 includes a discharge roller unit 70 provided between the fixing unit 30 and the sheet outlet 12, for discharging the sheet P.

A control unit 80 controls a tractor motor 84 for driving the tractor unit 6, a fixing motor 82 (described below) for driving the fixing unit 30, and a main motor 86 for rotating the drum 16.

A printing process is carried out in the following manner. A laser beam is emitted from the laser scanning unit 15 and directed to a circumferential surface of the drum 16. The drum 16 has been uniformly charged in advance by the charging unit 17, such that, when the drum 16 is exposed by the modulated laser beam, a latent image is formed thereon. At the developing unit 18, toner is applied to the latent image formed on the drum 16, and a toner image is thus formed on the drum 16. The toner image is transferred onto the sheet P at a corona charger 19 provided in the transfer unit 20. The toner image transferred onto the sheet P is fixed on the sheet P by the application of pressure and heat at the fixing unit 30. As the drum 16 rotates, any residual toner remaining on the drum 16 is removed by the cleaning unit 13, and the drum 16 is discharged by the discharge unit 14 to prepare for the next printing.

The fixing unit 30 includes a heat roller 40 accommodating a heat source therein and a press roller 45 having a surface made of an elastic member. The heat roller 40 is driven by the fixing motor 82.

The fixing unit 30 is provided with an opening/closing mechanism 33 for opening and closing the heat roller 40 and the press roller 45. The opening/closing mechanism 33 moves the press roller 45 between an operating position, where the sheet P is pressed between the press roller 45 and the heat roller 40, and a retracted position, where the press roller 45 is retracted from the operating position. In particlular, the opening/closing mechanism 33 includes a cam mechanism 33*a* driven by the fixing motor 82 via an electromagnetic clutch (not shown) and a swing lever 33*b* driven by the cam mechanism 33*a* to vertically lift up the press roller 45.

In the transfer unit 20, the corona charger 19 is supported by a swingable holder 22 swingably provided around a swing axis 21 so as to be movable between an operating position adjacent to the surface of the drum 16 and a retracted position away from the drum 16. The swingable holder 22 is swung by a slide arm 23 which, linked with the opening/closing mechanism 33, slides to the right and to the left in the view of FIG. 1. Further, a discharge roller unit 70 includes an upper roller 71 and a lower roller 72 disposed above and below the sheet P, respectively. The upper roller 71 is linked with the opening/closing mechanism 33 via a mechanism (not shown) and moves between an operating position where the sheet P is sandwiched between the upper and lower rollers 71 and 72 and a retracted position where the upper roller 71 is retracted from the operating position. The lower roller 72 is rotated by the fixing motor 82 via a gear mechanism (not shown).

Although the sheet P is in contact with the heat roller 40, the pressure roller 45 and the rollers of the discharge roller unit 70 during printing, the feeding speed is determined by the tractor unit 6. Further, in order to give tension to a portion of the sheet P between the discharge roller unit 70 and the tractor unit 6, when the sheet P is fed in a forward direction, the circumferential speed of the lower roller 72 is set to be slightly faster than the feeding speed of the sheet P by the tractor unit 6.

The printer 1 is arranged to discharge a printed page of the sheet P upon completion of the printing so that a user may check or separate the printed page. Further, the printer 1 is arranged to feed (retract) the sheet P in the reversed direction before the next printing is started. When the sheet P is being fed in the reversed direction or is stopped, the press roller 45, the corona charger 19, and the upper roller 71 are moved to their retracted positions by the opening/closing mechanism 33, to thereby release the sheet, P for easy movement along the feeding path.

Figure 2:
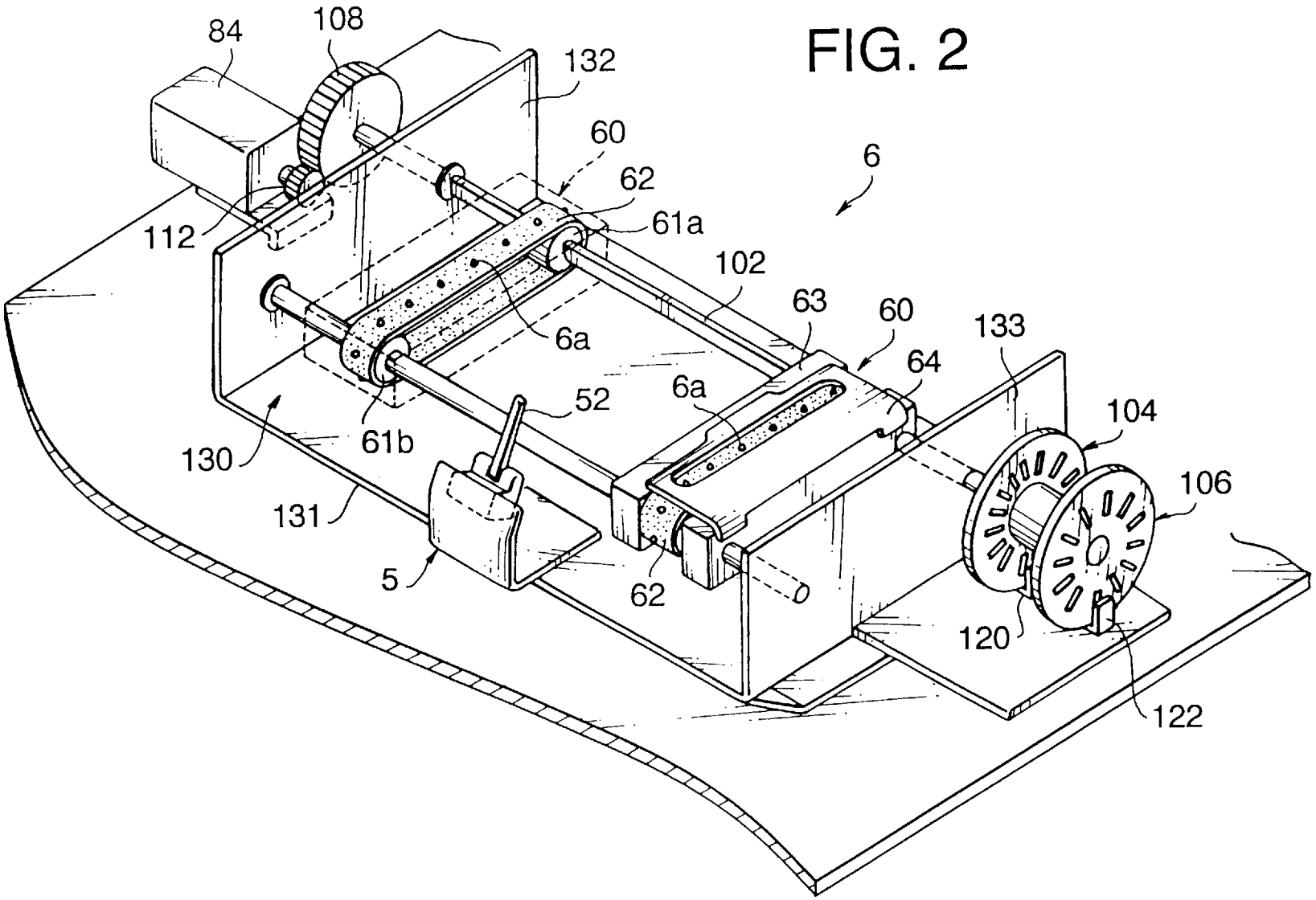
FIG. 2 is a perspective view of a tractor unit of the printer of FIG. 1.

The construction of the tractor unit 6 is now described. FIG. 2 is a perspective view of the tractor unit 6. The tractor unit 6 includes a U-shaped unit frame 130 and the two tractors 60. The unit frame 130 includes a bottom plate 131 secured to the housing 10, and a pair of side plates 132 and 133.

Each tractor 60 includes a tractor belt 62 and the pulleys 61*a* and 61*b* for driving the tractor belt 62. The tractor belt 62 and the pulleys 61*a* and 61*b* are rotatably supported in a support frame 63. In FIG. 2, the support frame 63 on the left side is shown by dotted lines in order to show the pulleys 61*a* and 61*b* and the tractor belt 62 accommodated therein.

Each support frame 63 is provided with a swinging cover 64 to cover the upper side of the tractor belts 62 thereby to maintain the engagement of the feed holes of the sheet and the protrusions 6*a* of the tractor belts 62. To set the sheet in the tractors 60, the swinging covers 64 are swung up to open the upper side of the tractor belts 62. Then, after the feed holes of the sheet are fit to the protrusions 6*a* of the tractor belts 62, the swinging covers 64 are closed to hold the sheet to the tractor belts 62.

A drive shaft 102, provided for driving the pulleys 61*a*, extends through the driving pulleys 61*a* and extends outwardly at the left side plate 132 and at the right side plate 133, respectively. The drive shaft 102 is provided with a slave gear 108, at the left end (in the view of FIG. 2) of the drive shaft 102, which is driven by the tractor motor 84 via a driving gear 112. The tractor motor 84 is mounted on the left side plate 132.

Further, the drive shaft 102 is provided, at the right end thereof, with encoder wheels 104 and 106 for outputting feed pulses to indicate feeding of the sheet by a predetermined amount. A rotation of the encoder wheels 104 and 106 is sensed by encoder sensors 120 and 122, respectively. The control unit 80 (FIG. 1) selects one or both of the encoder sensors 120, 122 according to a page length input through a control panel 8 (FIG. 1) to control the feeding of the sheet based on the feed pulses output from the corresponding encoder sensors 120, 122.

Figure 3:
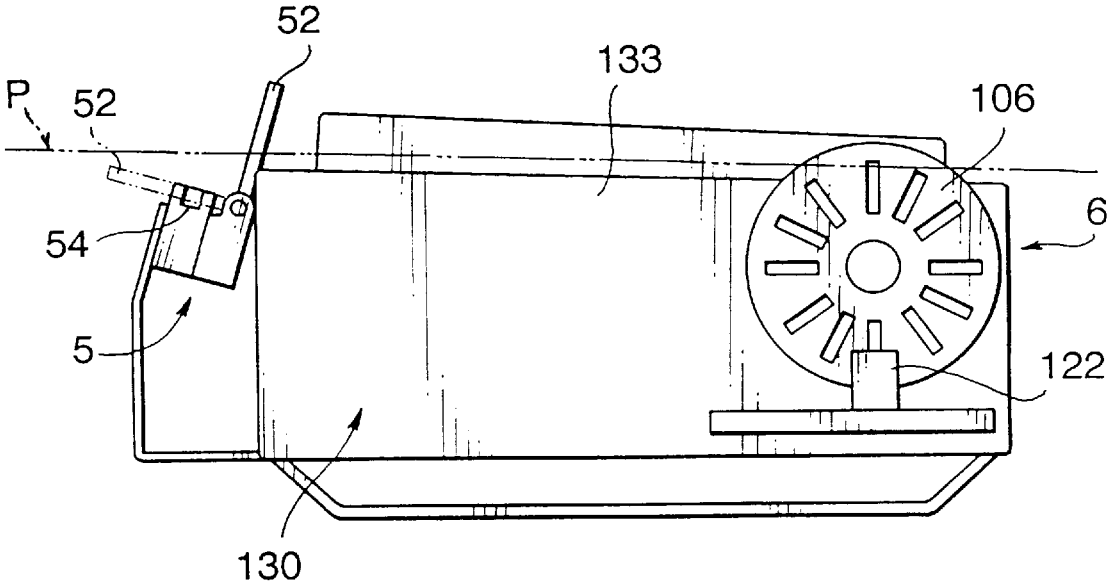
FIG. 3 is a side view of the tractor unit of FIG. 2.

A top sensor 5 is now described. FIG. 3 is a right side view of the tractor unit 6. The top sensor 5 includes a swingable lever 52 swingable between an erect position (shown by a solid line) and a retracted position (shown by a dotted line). When the swingable lever 52 is in the erect position, the swingable lever 52 projects across the feeding path of the sheet P. The swingable lever 52 is biased upward by means of a torsion spring (not shown). The top sensor 5 further includes a detecting sensor 54 which is a photosensor for detecting the swingable lever 52. The detecting sensor 54 is constructed to generate an OFF signal when the swingable lever 52 is in the erect position and to generate an ON signal when the swingable lever 52 is in the retracted position.

A control of the printer is described.

Figure 4:
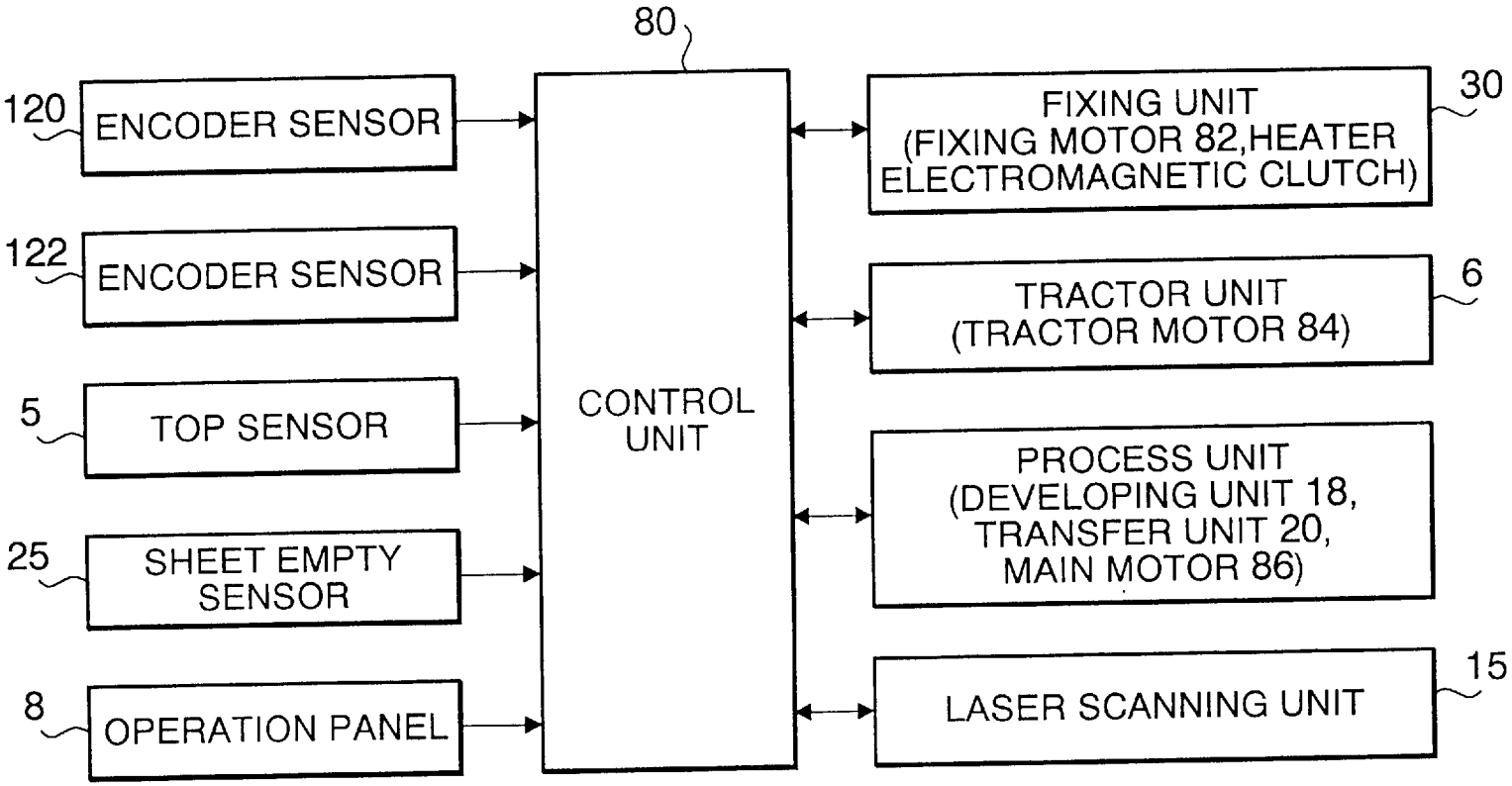
FIG. 4 is a block diagram of the printer shown in FIG.

FIG. 4 is a block diagram of the printer 1. The control unit 80 receives signals from the operation panel 8, the top sensor 5, the encoder sensors 120, 122, and a sheet empty sensor 25. According to the signals received, the control unit 80 controls the tractor unit 6, the fixing unit 30 (including the fixing motor 82 and the heat source), the laser scanning unit 15, and a process unit (including the developing unit 18, the transfer unit 20, the main motor 86, and the like).

Figure 5:
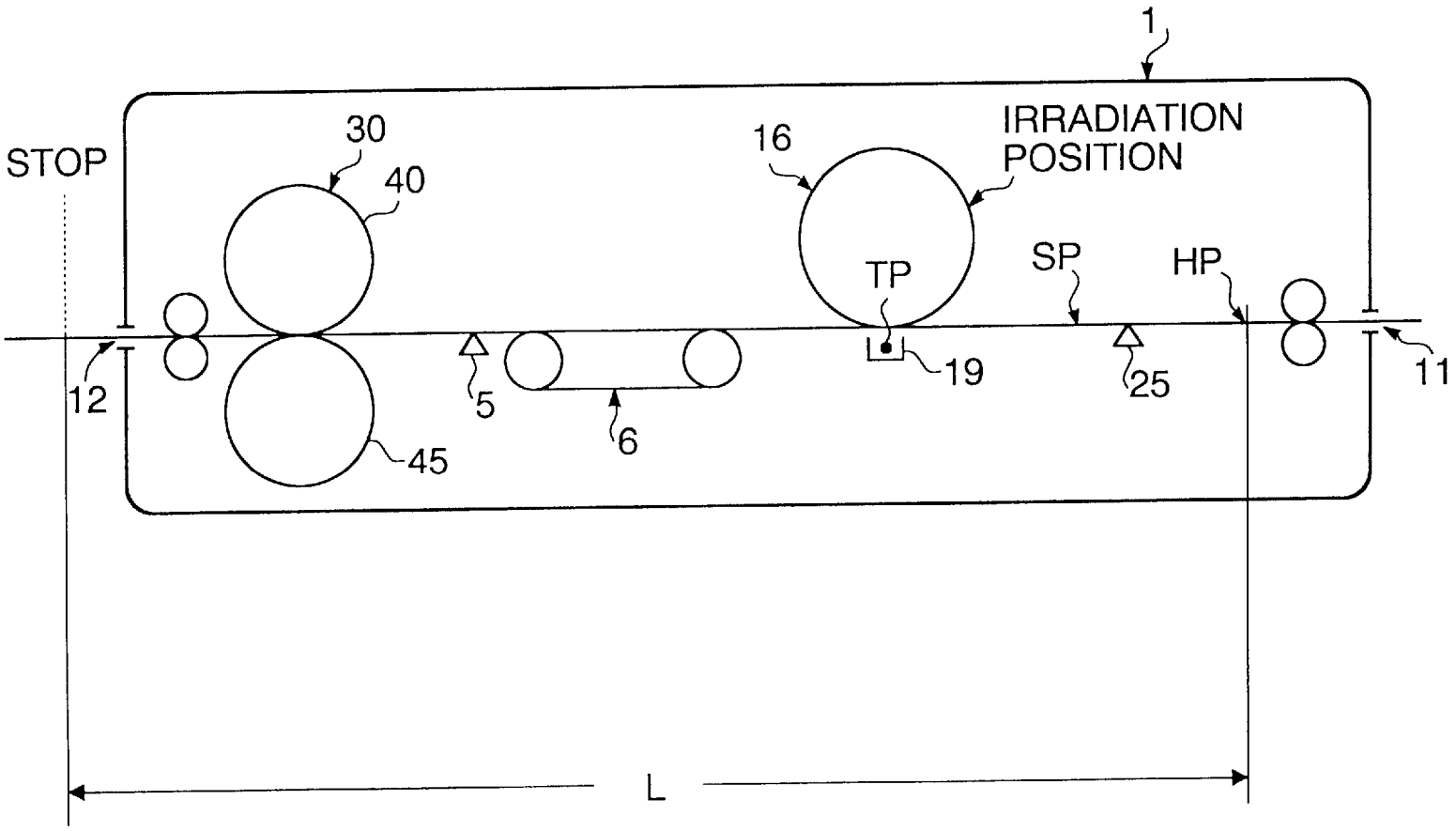
FIG. 5 is an explanatory view indicating positional relationships among each of the elements of the printer.

FIG. 5 is an explanatory view indicating positional relationships among each of the elements of the printer 1. In FIG. 5, the circumferential position on the drum 16 at which the laser beam from the laser scanning unit 15 reaches the drum 16 is designated an "irradiation position". Further, various positions are defined on the feeding path of the sheet P. A transfer position TP is defined as the position on the feeding path at which the toner image is transferred to the sheet P. A synchronous position SP is defined as a position on the feeding path that is upstream from the transfer position TP by a distance equivalent to the circumferential distance about the drum 16 from the transfer position TP to the irradiation position. A home position HP is defined as a position that is a predetermined distance upstream from the synchronous position SP. The home position HP represents the position at which leading perforations of the sheet P are to be positioned when the printing is to be started. When the perforations between pages reach the synchronous position SP, an exposure operation (i.e., scanning by the laser scanning unit 15) is started. Further, a stop position STOP is defined as a position a predetermined distance outside of the sheet outlet 12. As shown in FIG. 5, there is a distance "L" between the stop position STOP and the home position HP. In this embodiment, the page length is greater than the distance between the top sensor 5 and the home position HP.

When power is supplied to the printer 1, various checks are first performed, for example, a memory check for ROM (read only memory) (not shown) and RAM (random access memory) (not shown) in the control unit 80, an operation check for the laser scanning unit 15, a toner check for the developing unit 18, a sheet check by the sheet empty sensor 25 to determine if a sheet P is loaded, and the like. Then, heating of the heat roller 40 of the fixing unit 30 starts to prepare the printing operation.

Figure 6:
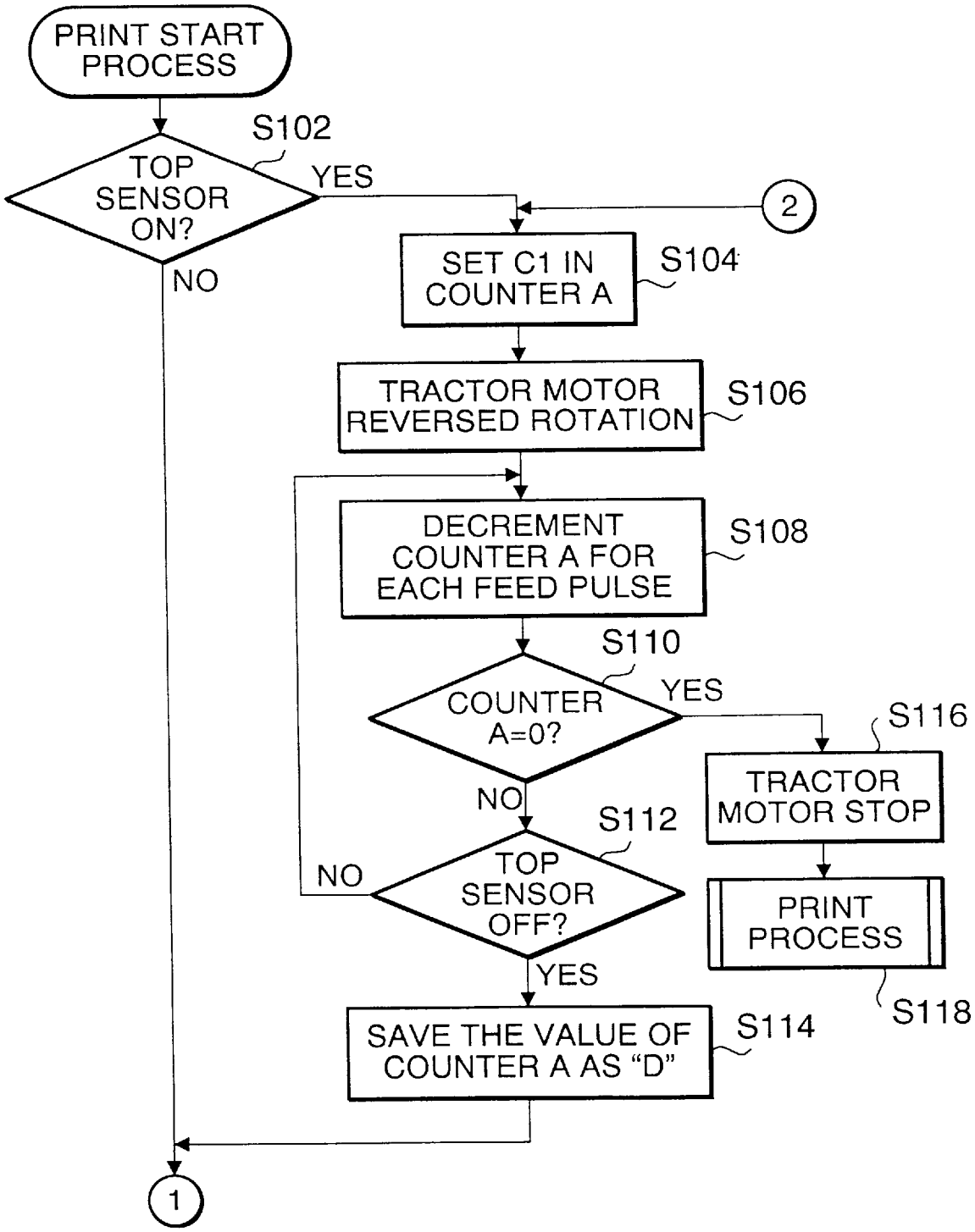
FIGS. 6 and 7 are flowcharts of a print start process according to the embodiment.
Figure 7:
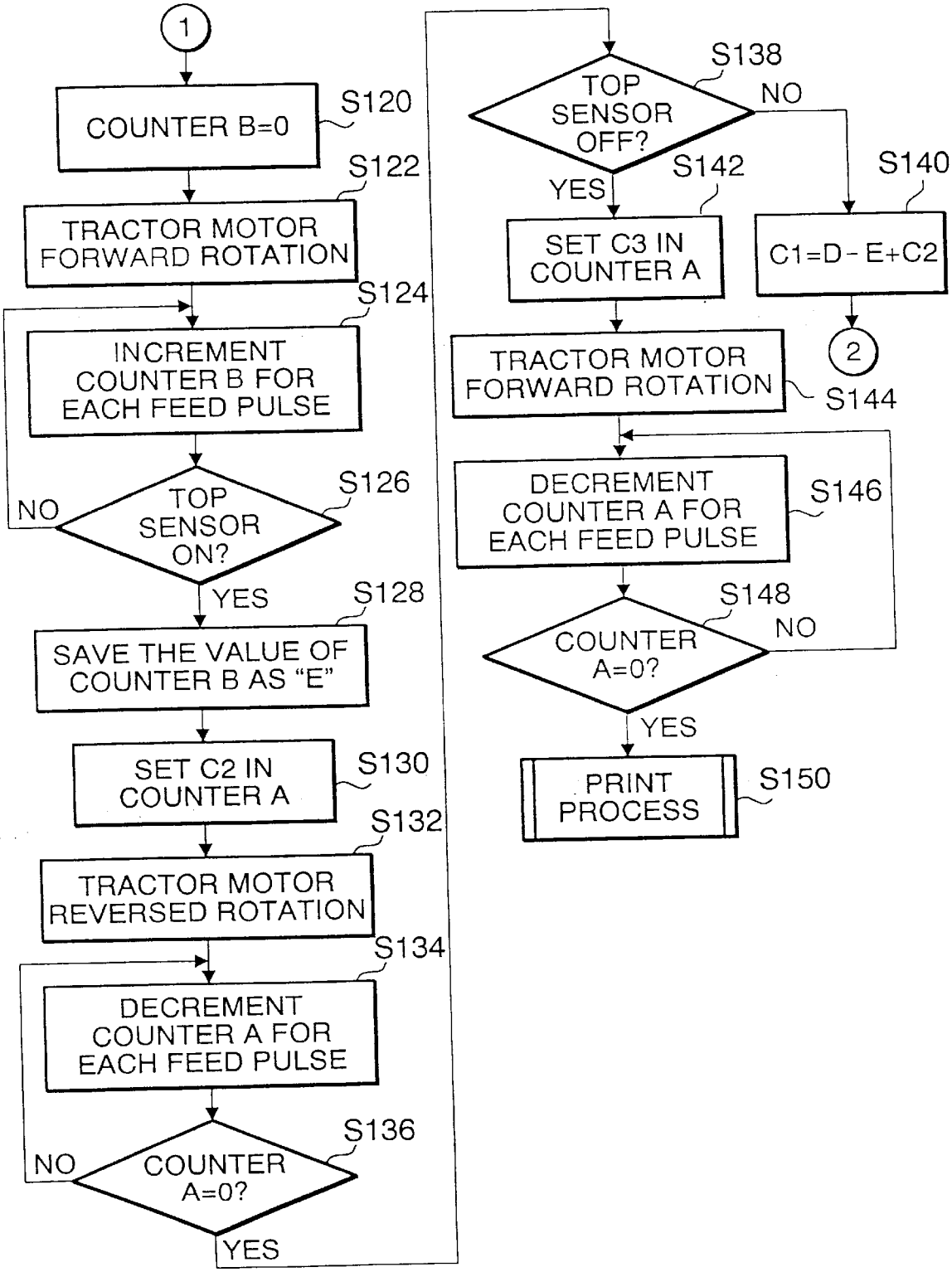

FIGS. 6 and 7 are flow charts illustrating a print start process. The print start process is performed when a print request is received from a computer not shown or the like, for positioning the leading perforations of a page (from which the printing is to be started) to the home position HP. First, the control unit 80 checks whether the top sensor 5 is ON at step S102 (that is, whether the lever 52 is pressed downward to the retracted position by the presence of the sheet). When the top sensor 5 is OFF (NO at step S102), the control unit 80 determines whether the detection of the leading edge is correct or not in steps S120–S140 (FIG. 7) which are described below. When the top sensor 5. is ON at step S102 (YES at step S102), it indicates that trailing perforations of the last printed page (where the previous printing is ended) are located at the stop position (STOP) outside the printer 1. In this state, a user may have checked the last printed page and may have separated the page by tearing along the trailing perforations of the last printed page. If the last printed page is not separated by a user, the control unit 80 controls the tractor unit 6 to locate the trailing perforations of the last printed page at the home position HP. Conversely, if the last printed page has been separated from the sheet, the control unit 80 controls the tractor unit 6 to locate the trailing perforations of the next page following the last printed page (hereinafter the first page following) at the home position HP, since the first page following must remain on the tractor unit 6 to ensure the engagement of the sheet P and the tractor unit 6.

Thus, a number C1 of feed pulses corresponding to the distance L is set in a counter A (S104), the tractor motor 84 is driven in the reversed direction (S106), the counter A is decremented every time a feed pulse is outputted, and it is determined whether the counter A indicates zero or not and whether the top sensor 5 is turned OFF or not (S108, S110, and S112).

If the counter indicates zero with the top sensor 5 remaining ON, it indicates that the last printed page of the sheet P is not separated. Then, the feed of the sheet P is stopped when the trailing perforations of the last printed page reach the home position HP. More specifically, if the counter indicates zero at steps S110, the tractor motor 84 is stopped to stop the feed of the sheet P (S116). In this state, the trailing perforations of the first page following (leading perforations of a second page following) reach the home position HP, and a printing process (S118) is performed.

Conversely, if the top sensor 5 is turned OFF while the sheet P is fed in the reversed direction, the control unit 80 determines whether the detection of the leading edge is correct or not in steps S120–S140 (FIG. 7).

In steps S120–S140, the control unit 80 drives the tractor unit 6 to feed the sheet P in the forward direction (until the top sensor turns ON again), and then to feed the sheet P in the reversed direction. During this reverse feeding of the sheet P, the control unit 80 determines whether the top sensor 5 is again turned OFF. When the sheet P is fed in the forward direction, a tension is given to a portion of the sheet P between the discharge roller unit 70 and the tractor unit 6 as described above. If the sheet P is bent upward, the bending of the sheet P is removed by the tension caused by the discharge roller unit 70 and the tractor unit 6. Thus, if the swingable lever 52 is raised due to the bending of the sheet P, the swingable lever 52 is not raised and the top sensor 5 is not turned OFF during the reverse feeding of the sheet P (after the forward feeding).

More specifically, if the top sensor 5 is turned OFF while the sheet P is fed in the reversed direction (YES at S112), the sheet P is once fed in the forward direction until the top sensor 5 is turned ON (S122, S124, and S126). After the top sensor 5 is turned ON, the tractor motor 84 is driven in the reversed direction by a predetermined amount (corresponding to a number C2 of feed pulses) at steps S130, S132, S134, and S136. Then the control unit 80 determines whether the top sensor 5 is again turned OFF (S138). In this embodiment, the amount of the reverse feeding is 2 to 3 inches.

If the top sensor 5 is not turned OFF while the sheet is fed in the reversed direction (NO at S138), the control unit 80 decides that the detection of the leading edge is not correct. Then, the reverse feeding operation of the sheet P (steps S104–S118) is again carried out. Since the leading perforations of the first page following (the trailing perforations of the last printed page) have moved upstream of the stop position (STOP), the reverse feeding amount is compensated (step S140). For this compensation, the number of feed pulses corresponding to the remaining feeding amount at the time when the top sensor 5 is turned OFF at step S112 is stored as D at step S114, and the number of feed pulses corresponding to the forward feeding amount at the steps S122, S124 and S126 is stored as E (step S128). The number of feed pulses C1 corresponding to the reverse feeding retracting amount is compensated as follows:

$$C1=D-E+C2 \quad (1)$$

By feeding the sheet P in the reversed direction (steps S104–S116), based on this compensated reverse feeding amount, leading perforations of the first page following are located at the home position HP.

Conversely, if the top sensor 5 is turned OFF (Yes at step S138), the control unit 80 decides that the detection of the leading edge is correct. In this state, the first page following the sheet P is on the tractor unit 6 and the trailing perforations of the first page following (the leading perforations of the second page following) are located on the upstream side of the home position. Therefore, the sheet P is fed in the forward direction to locate the leading perforations of the second page following at the home position HP.

In particular, a number C3 of feed pulses corresponding to the distance between the leading perforations (located on the top sensor 5) of the first page following and the home position (HP) is set in the counter A (S142), the tractor motor 84 is driven in the forward direction (S144) until the counter A indicates zero (steps S146 and S148). When the leading perforations of the first page following reach the home position (HP), a printing process (S150) can be performed. Since the printing process is carried out in the same way as in a conventional printer, the description of the printing process is omitted.

As described above, according to the embodiment, if the top sensor 5 detects the leading edge while the sheet P is fed in the reversed direction, the control unit can determine whether the detection of the leading edge is correct or not by feeding the sheet P once in the forward direction and then feeding it in the reversed direction and checking whether the top sensor 5 again detects the leading edge of the sheet P fed in the reversed direction. Further, if the control unit 80 decides that the detection of the leading edge is found to be not correct, the control unit 80 restarts the reverse feeding operation.

Thus, the incorrect printing caused by the incorrect detection of the leading edge of the sheet can be prevented.

Although the structure and operation of a printer and a sheet feeding system thereof are described herein with respect to the preferred embodiment, many modifications and changes can be made without departing from the spirit and scope of the invention.

The present disclosure relates to subject matter contained in Japanese Patent Application No. HEI 08-247128 filed on Aug. 29, 1996 which is expressly incorporated herein by reference in its entirety.

What is claimed is:

1. A printer for printing images on a sheet, said printer comprising:

a tractor unit capable of feeding said sheet in first and second directions;

a top sensor which detects the passage of a leading edge of said sheet fed by said tractor unit; and a control unit which controls said tractor unit, said control unit determining whether the detection of said leading edge by said top sensor is correct, wherein, if said top sensor detects the leading edge of said sheet fed in said first direction, said control unit controls said tractor unit to once feed said sheet in said second direction and then to feed said sheet in said first direction by a predetermined amount, and checks whether said top sensor again detects the passage of said leading edge of said sheet being fed in said first direction.

2. The printer according to claim 1, wherein said control unit controls said tractor unit to feed said sheet in said second direction when said printer prints images on said sheet.

3. The printer according to claim 2, wherein said control unit controls said tractor unit to feed said sheet in said second direction to once discharge a printed portion of said sheet out of said printer upon completion of said printing, and to retract said sheet in said first direction before the next printing is started.

4. The printer according to claim 3, wherein, if said control unit determines that the detection of said leading edge is not correct, said control unit restarts the retracting of said sheet in said second direction.

5. The printer according to claim 4, wherein said control unit compensates the amount of said sheet to be fed in said first direction, prior to said restart of said retracting of said sheet in said second direction.

6. The printer according to claim 1, further comprising a tensioning system which imparts a tension to said sheet.

7. The printer according to claim 6, said top sensor being positioned downstream of said tractor unit in said second direction, and said tensioning system being positioned downstream of said top sensor in said second direction.

8. The printer according to claim 6, said tensioning system comprising a pair of rollers sandwiching said sheet, wherein a circumferential speed of at least one of said pair of rollers is faster than the feeding speed of said sheet.

9. The printer according to claim 6, further comprising a fixing unit which fixes an image onto said sheet, wherein said fixing unit is located between said top sensor and said tensioning system.

10. The printer according to claim 1, wherein said control unit controls said tractor unit to feed said sheet in said second direction until said top sensor detects said leading edge of said sheet.

11. The printer according to claim 1, wherein said top sensor comprises:

a swingable lever swingable between an erect position wherein said swingable lever projects across a sheet feeding path of said sheet and a retracted position wherein said swingable lever is retracted from said erect position; and a sensor which detects the position of said swingable lever.

12. The printer according to claim 11, wherein said top sensor is arranged to output a first signal indicating that said swingable lever is in said erect position and a second signal indicating that said swingable lever is in said retracted position.

13. A feeding system for feeding a sheet, comprising:

a tractor unit which feeds said sheet;

a top sensor which detects a leading edge of said sheet fed by said tractor unit; and a control unit which controls said tractor unit, said control unit determining whether said detection of said leading edge by said top sensor is correct, wherein, if said top sensor detects the leading edge of said sheet fed in a first direction, said control unit controls said tractor unit to once feed said sheet in a second direction and then to feed said sheet in said first direction by a predetermined amount, and determines whether said top sensor again detects the leading edge of said sheet being fed in said first direction.

14. The feeding system according to claim 13, further comprising a tensioning system which imparts tension to said sheet.

15. The feeding system according to claim 14, wherein said top sensor is located downstream of said tractor unit in said second direction, and wherein said tensioning system is located downstream of said top sensor in said second direction.

16. The feeding system according to claim 14, said tensioning system comprising a pair of rollers sandwiching said sheet, wherein a circumferential speed of at least one of said pair of rollers is larger than the feeding speed of said sheet.

17. The feeding system according to claim 13, wherein said top sensor comprises:

a swingable lever swingable between an erect position wherein said swingable lever projects across a sheet feeding path of said sheet and a retracted position wherein said swingable lever is retracted from said erect position; and a sensor to detect the position of said swingable lever.

18. The Seeding system according to claim 17, wherein said top sensor is arranged to output a first signal indicating that said swingable lever is in said erect position and a second signal indicating that said swingable lever is in said retracted position.

* * * * *